United States Patent [19]

Schippers et al.

[11] 3,964,723

[45] June 22, 1976

[54] AUTOMATIC SPOOL-CHANGING APPARATUS

[75] Inventors: Heinz Schippers; Karl Bauer; Erich Lenk; Manfred Mayer, all of Remscheid-Lennep; Hans Jochen Busch, Remscheid, all of Germany

[73] Assignee: Barmag Barmer Maschinenfabrik Aktiengesellschaft, Wuppertal, Germany

[22] Filed: June 4, 1975

[21] Appl. No.: 583,849

[30] Foreign Application Priority Data

June 4, 1974 Germany ..... 2427016

[52] U.S. Cl. ..... 242/35.5 A; 242/18 A; 242/18 DD; 242/41

[51] Int. Cl.[2] ..... B65H 67/04

[58] Field of Search ..... 242/18 R, 18 A, 18 DD, 242/35.5 R, 35.5 A, 41; 57/52, 53

[56] References Cited

UNITED STATES PATENTS

| | | | |
|---|---|---|---|
| 3,762,661 | 10/1973 | Lucke | 242/18 R |
| 3,791,125 | 2/1974 | Kawakami | 57/52 |
| 3,793,818 | 2/1974 | Yamamoto | 57/52 |
| 3,908,918 | 9/1975 | Bergstrom | 242/18 R |
| 3,913,852 | 10/1975 | Lenk et al. | 242/18 A |
| 3,921,922 | 11/1975 | Wust | 242/18 A |

*Primary Examiner*—John Petrakes
*Attorney, Agent, or Firm*—Johnston, Keil, Thompson & Shurtleff

[57] ABSTRACT

An automatic spool-changing system for textile machines with an array of high-speed winding heads, for example of the type having a spool revolver and a lossless thread transfer device. The system has a conveyor moving along the machine front and a spool changer with a gripper movable between the conveyor and a spool holder in a spool-changing position. The conveyor is located below and in generally the same vertical plane with the spool holder, and the gripper, which is arranged for both rotation and axial translation, is mounted for movement along a three-legged spool doffing and spool-donning path extending forwardly of the machine front. Two embodiments are shown. In the first, a separate empty-spool magazine is provided and the conveyor merely serves to carry away the empty spools. In the second, the conveyor serves for the transportation both of full spools and empty spools; in this case the gripper has two angularly displaced heads so that it can execute a spool-doffing and spool-donning operation simultaneously. Controls for the spool-changing system are also disclosed.

16 Claims, 15 Drawing Figures

AUTOMATIC SPOOL-CHANGING APPARATUS

BACKGROUND OF THE INVENTION

The invention relates to automatic spool-changing arrangements or systems for textile machines, particularly machines of this type with a plurality of winding devices or winding heads which are disposed in horizontal array along the front of the machine and serve to wind a multifilament synthetic yarn which is continuously fed to the winding device at a constant high velocity. Typically each of these winding devices has, in a corresponding spool-changing position, a spool holder journaled in the machine, with the axis of the spool-holder projecting from the machine front.

Automatic spool-changing arrangements of the kind just mentioned are known in many forms of implementation. They serve to take the fully wound spools or bobbins (finished bobbins) from their spool holder, for example a chuck, and to lay them on a conveying arrangement (for example a spool carriage or a revolving conveyor). The automatic spool-changing system may also be arranged to effect the conveying of the tubes (empty tubes) from a tube storage location (for example a tube magazine, tube transport carriage or a revolving conveyor) to the spool holder and the placing of the empty tubes on the spool holder, for instance, by sliding the empty tubes onto a chuck.

Many of these implementations suffer from the disadvantage that the design of the textile machine and of its spool-changing system are not optimally harmonized with each other. The imperfect adaptation of the spool-changing system to the design of the textile machine and vice versa results in a construction of the spool-changing apparatus which is kinematically complicated and costly. As a consequence, the functional capability, the operational safety and thus the possibilities for an economic utilization of the spool-changing apparatus are limited.

OBJECTS AND SUMMARY OF THE INVENTION

It is an object of the present invention to coordinate from the outset the overall design of textile machines and the design of spool-changing apparatus in such a way that the spool-changing apparatus becomes of simple construction and uses simple kinematics for its individual elements. Thus it is another object of the invention to lower the costs for the control of the individual movements and functions, to increase the functional capability and operational safety and to provide for economic utilization of the spool-changing apparatus. Yet another object of the invention is to keep the service space forwardly of the machine front from being obstructed by machine elements of the spool-changing apparatus.

The foregoing and other objects are met, briefly, by mounting, in a textile machine of the kind described above, a spool conveyor for horizontal movement along the machine front; by providing an automatic spool-changing apparatus with gripper means which are movable between the conveyor and the spool-changing position of the corresponding spool holder; by disposing the conveyor in substantially the same vertical plane with, and at a level below the spool holders; and by mounting the gripper means for movement along a three-legged spool-doffing path extending forwardly of the machine front. More particularly, the first leg of this path extends from the spool-changing position of the spool holder, along a line parallel to the axis thereof, forwardly to an upper out-of-the-way position; the second leg extends, in a plane perpendicular to the axis of the holder, from the aforementioned upper out-of-the-way position to a lower out-of-the-way position; and a third leg extends from the foregoing lower out-of-the-way position, along a line parallel to the axis of the holder, rearwardly to a conveyor discharge zone.

Let it be noted in passing that it is possible to slip one or more tubes on a tube chuck and, accordingly, to wind one or more bobbins simultaneously. Furthermore, the term "gripping means" or "gripper" as used herein should be understood to define any suitable arrangement, for example, also a movable slip-on mandrel, which is centrally inserted into the spool or tube or onto which the tube is slipped.

The invention makes possible a narrow design for the textile machine including the spool-changing system, with only a slight expenditure per winding device. Traffic of bobbin carriages or of automatic spool changers which are movable forwardly of the machine front or are automatically drivable, can be eliminated so that the space requirement of the machines is reduced. Because of its simplicity, the spool-changing arrangement according to the invention is functionally efficient and safe. It permits both a random and a cyclic spool change. In conjunction with the use of a spool revolver, it becomes possible to fully automate the winding process and the lossless spool change. This is significant especially for an economic production of synthetic yarns at high deniers (for example carpet yarn with more than 500 den.) and high spinning or spin-stretching speeds (for example, 3,000 meters per minute) and the corresponding short winding times (bobbin journey of, for example, 10 minutes).

Preferably the gripper means comprise a shaft carrying at least one arm with a gripper head thereon and this shaft is mounted for shifting movement along, and swinging movement about, an axis extending perpendicularly to the front of the machine. Preferably, too, there are provided empty-tube storage means having an empty-tube supply location also lying in substantially the same vertical plane with the above spool-holders, and the gripping means are rendered movable over a three-legged spool-donning path generally similar to the aforementioned spool-doffing path but extending between the storage means and the spool-changing position of the spool holder. The advantage of this simplification is that only one movable part per winding device is required for the spool change.

The storage facility for the empty tubes may be a tube magazine which is mounted on each winding device in the range of movement of the gripper. In lieu of the foregoing, the conveyor may be equipped with two spool-holding devices per machine pitch which alternately provide empty-tube supply location and a first-spool deposition location, with the axes of the two devices being parallel to those of the spool holders and lying on the swinging path of the gripper head. The advantage of this technique lies in that not only the gripper but also the conveyor assumes the dual function of supplying the winding device with empty tubes and of taking off and conveying away the finished bobbins.

As is well known, any automation entails a considerable expenditure for the control of the functions and movements of the automatic spool-changing system. The controls are in part mechanical, and to another part they may be pneumatic, hydraulic, electric or electronic elements and circuits. The economic employment of the controls determines to a large extent the economy of the automatic spool-changing system. Theoretically two possibilities offer themselves for keeping the expenditure for the control low: For one thing, the construction with its functions and paths of movement must be kept so simple that only a small control expenditure is required per winding device and automatic spool-changing apparatus. For another, the controls should at least in part be associated with a plurality of winding devices and their spool-changing apparatus in common. This too, is possible only through a corresponding design of the automatic spool-changing system.

It is, therefore, a further object of the invention to provide a spool-changing arrangement which makes possible a low control expenditure per winding apparatus. This object is satisfied by mounting on the gripper shaft two angularly displaced arms each carrying, at the same radial distance from shaft axis, its own gripper head, thereby permitting a spool-doffing operation and a spool-donning operation to be simultaneously executed by the same swinging movement of the shaft. The advantage of this implementation lies in that the gripper, by one and the same movement carries out two functions simultaneously, namely the doffing of the finished bobbin and the donning of the empty tube.

BRIEF DESCRIPTION OF THE DRAWINGS

Preferred embodiments of the invention will now be described with reference to the accompanying drawings in which.

DETAILED DESCRIPTION

Figure 1:
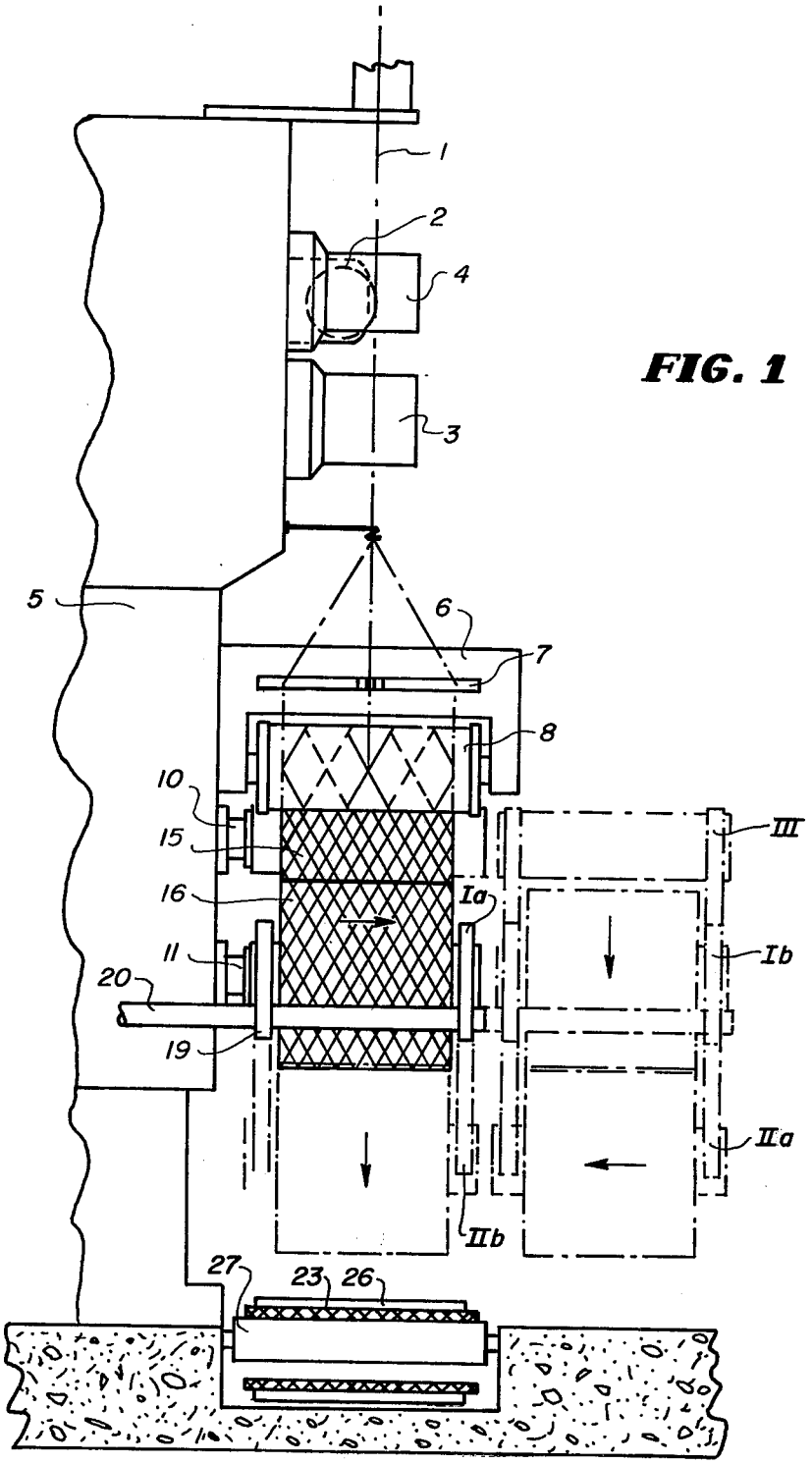
FIG. 1 is a side view in partial section of a textile machine with a first embodiment of a spool-changing apparatus according to the invention, having associated therewith a conveyor which in this case merely serves for the carrying away of full spools.

The automatic spool-changing apparatus according to the invention is shown implemented in the two embodiments, FIGS. 1, 2 and 3, 4 in connection with substantially similar winding apparatus or devices of a synthetic yarn-spinning installation. In FIGS. 1, 2 and 3, 4 parts of essentially the same function have been given the same reference numerals except that in FIGS. 3, 4 the reference characters in question have been primed. Thus, referring to both embodiments, and with the reference numerals for FIGS. 3, 4 placed in parentheses:

1 (1') is a thread,
2 (2') is a finishing, or preparation, roller,
3 (3') is a godet,
4 (4') is a godet, and
5 (5') is a winding apparatus or device. This winding apparatus includes:
6 (6') a support or slide, the latter containing
7 (7') a traversing device,
8 (8') a roller or traversing roller, and
9 (9') a drive roller. The winding apparatus further includes:
10 (10') a tube chuck,
11 (11') a tube chuck, both of these projecting from, and being mounted for rotation in,
12 (12') a spool revolver,
13 (13') guide grooves for slides 6, and
14 (14') a thread applying device for lossless spool change Winding apparatus of the design illustrated have been disclosed, for example, in the following U.S. patents or patent applications: U.S. Pat. No. 3,825,206 to H. Schippers et al, issued July 23, 1974, on a "Winding Device with Drive Roller"; U.S. patent application Ser. No. 456,222, filed Mar. 29, 1974, by E. Lenk et al, now U.S. Pat. No. 3,913,852, on a Winding Apparatus and Process, and U.S. patent application Ser. No. 534,648, filed Dec. 19, 1974, by H. Schippers et al on a Winding Machine with Multi-Chuck Bobbin Revolver. The contents of these, as well as the other patents and patent applications referenced below, should be considered incorporated herein for purposes of disclosure.

Figure 2:
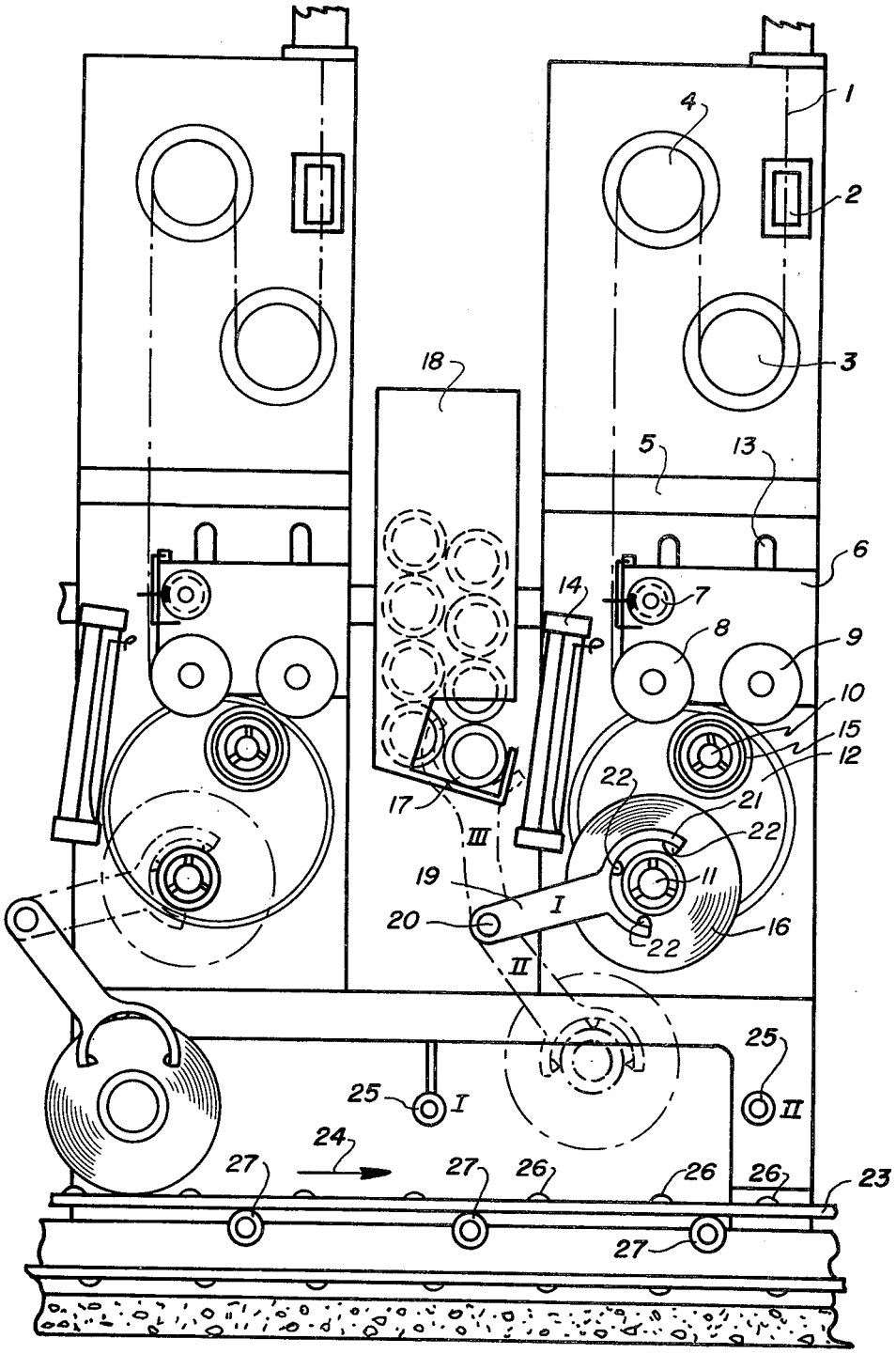
FIG. 2 is a front view of the textile machine shown in FIG. 1.

With revolver 12 in the position shown in FIGS. 1 and 2, tube chuck 10 which carries partially filled spool or bobbin 15 is in operating position. Tube chuck 11 which is in inoperative or spool-changing position carries the finished spool 16. It should be noted that with a corresponding modification of traversing device 7 and traversing roller 8, it is also possible to produce on one chuck two or more spools, on a tube, reference being made, for example, to U.S. Pat. No. 3,792,879, to H. Schippers, issued Feb. 19, 1974.

In FIGS. 1 and 2, the spool-changing apparatus consists, for one thing, of the gripper 19 with the gripping head 21 and the gripping claws 22. The gripping claws 22 are operated by a pneumatic cylinder-piston unit (not shown herein, but known per se) which is mounted in gripper 19. Gripper 19 is rockable about the axle 20. In addition, axle 20 is slidable in axial direction. Further, there is associated with the automatic spool changing apparatus an empty tube magazine 18 in which there are stored empty tubes 17.

Toward the front side of the textile machine the empty tube magazine 18 has an opening from which one empty tube may be slid at a time. A suitable construction for such a tube magazine has been disclosed in FIG. 4 and associated description of U.S. patent application Ser. No. 260,454, filed June 7, 1972, by G. Munnekehoff on an Automatic Spool Changer for Textile Machines, and corresponding to German published patent application DT-OS No. 2,218,974.

Finally there is associated with the automatic spool-changing apparatus the conveyor 23, which in FIGS. 1, 2 is a conveyor belt movable in the direction of arrow 24. The conveyor 23 is guided and possibly also driven by the rollers 27. On the upper side of the conveyor belt there are provided transverse bars 26, each forming on the conveyor belt depositing troughs for a finished spool. With 25 there are designated sensing devices, for example photoelectric cells I and II, which have the function of stopping the gripper drive, or else the drive of the conveyor, when there is danger that the gripper with a finished spool thereon will strike against a finished spool already on the conveyor. The gripper 19 is positionable in the three positions I, II, III of its rotary movement (see FIG. 2). The starting position I*a* (FIG. 1) of the gripper is selected and the gripping head inclined with its opening in such a way that on turning of the spool revolver 12 the tube ends of the finished spool travel into the gripping head 21. Now the gripping claws 22 are driven out and in this manner the tube of the finished spool is clamped fast in the gripper. After the chuck has first been released, the gripper now moves in an axial direction out of position I*a* into position I*b*, FIG. 1, is then swung out of position I*b* into position II*a* and from there again driven by axial movement of the axle 20 into position II*b*, in which the full spool is located over the conveyor 23. As described hereinbelow with reference to FIG. 5, translational drive of the gripper out of position II*a* into position II*b* can be blocked by the scanning (sensing) arrangement including photocells I and II, in conjunction with the control means shown in that figure.

In position II*b* the gripping claws 22 are released, so that the spool drops into a depositing trough of the conveyor 23. Thereupon the gripper moves out of position II*b* into position II*a* and is thereafter swung into position III. Here the gripper lies at the face opening of the tube magazine 18 so that an empty tube 17 may be axially thrust into the gripping head. Now the gripper moves out of position III back into position I*b* and then in axial direction into position I*a*. At this time the chuck can again be tensioned. It is assumed that the chuck in FIGS. 1, 2 is pneumatically tensioned and released in a manner not particularly illustrated herein but shown and described, for example, in U.S. Pat. No. 3,495,781. As soon as operating spool 15 is almost finished, the gripper is briefly driven into position I*b*. Thereupon the bobbin revolver 12 is rotated through such an angle that the empty tube (chuck 11) as well as the almost finished spool (chuck 10) are simultaneously engaged by the two rollers 8 and 9, respectively. In this position of the spool revolver 12 the thread is transferred from the finished spool (chuck 10) onto the empty tube (chuck 11) with the aid of thread applying device 14 which affords a lossless thread transfer. This device provides an auxiliary pneumatically actuated thread guide means by which the thread running into the almost finished bobbin is drawn out into a thread loop in such a way that the thread comes into a zone of action of a thread catching means on the rotating empty tube, or on the rotating chuck carrying the empty tube, and is caught. For details of this operation reference is made to the above-referenced U.S. patent application Ser. No. 534,648. During this time the gripper travels into position I*a* and can now receive the finished spool.

In FIG. 5 there are schematically represented scanning, or sensing, and control arrangements for the gripper drive, which prevent that the gripper with a finished spool held thereby, collides with a finished spool on the conveyor as the latter moves thereagainst.

Figure 4:
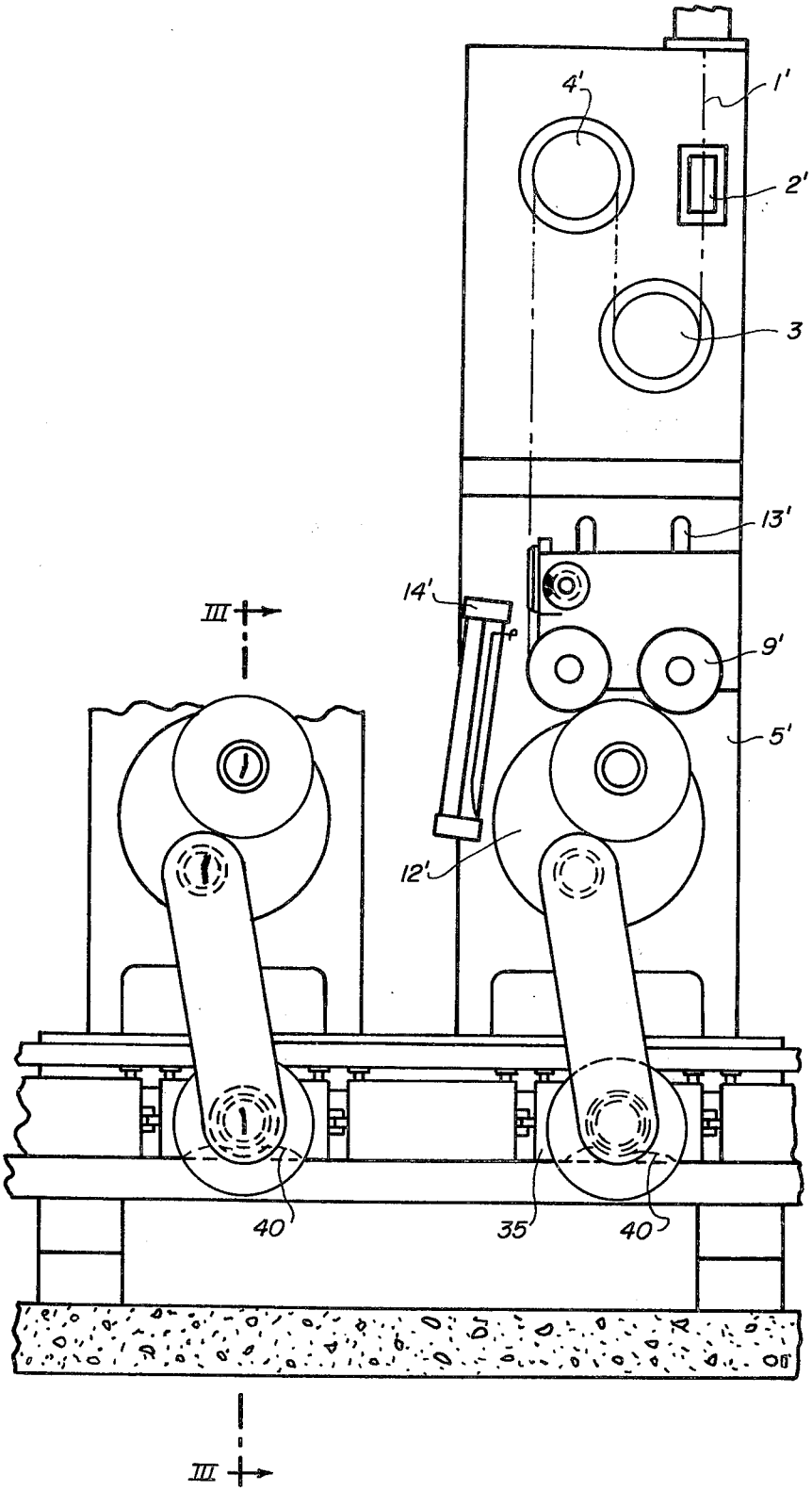
FIG. 4 is a partial front view of the textile machine shown in FIG. 3.
Figure 5A:
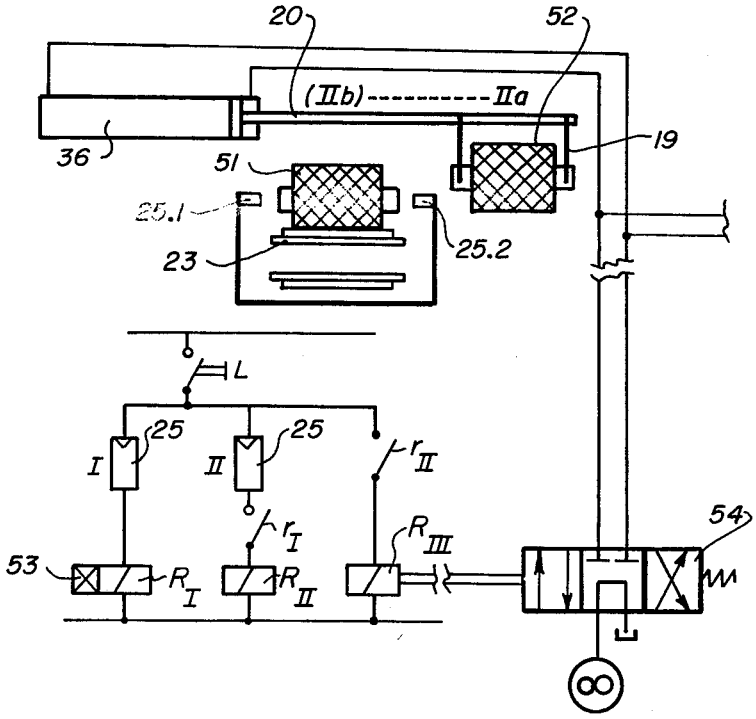
FIGS. 5*a*, *b* and *c* show scanning and control arrangements for the embodiment according to FIGS. 1, 2.
Figure 5B:
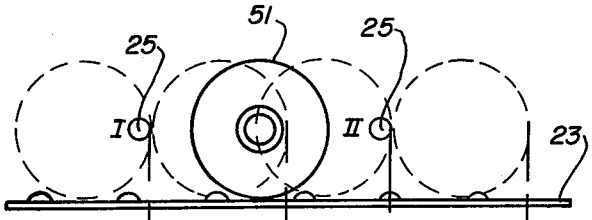

FIG. 5*a* shows the cylinder-piston unit (not illustrated in FIG. 1 but disclosed in detail in the embodiment according to FIGS. 3, 4) which serves for the axial movement of the gripper rod 20 with the gripper 19 and the finished spool 52 thereon. There is represented the case in which there is lying on the conveyor 23 another finished spool 51, namely, in the depositing trough on the conveyor, into which the finished spool 52 on the gripper would otherwise be deposited. The conveyor is scanned by the photoelectric cells 25 (I) and 25 (II). As shown in FIG. 5*b*, these photoelectric cells are disposed slightly ahead of and slightly behind the position in which the full bobbin 52 is to be deposited. The photoelectric cell arrangement consists as usual of a transmitter, 25.1, and a receiver, 25.2. The two photocells 25I and II, respectively, control relay $R_I$ having a contact $r_I$, and relay $R_{II}$ having a contact $r_{II}$. The latter controls relay $R_{III}$ which, in turn, operates spring-loaded valve 54.

Figure 5C:
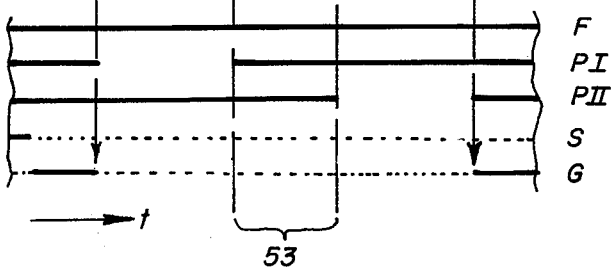

The chart of FIG. 5*c* shows the signals used in the control system. The conveyor receives the continuous signal F. Photoelectric cell I generates signal P1 which is interrupted when the spool 51 on the conveyor passes this photoelectric cell. Photoelectric cell II generates signal PII, likewise with a corresponding interruption. Origiinating from any desired source, for example a central control on the machine, a manual operating means, a scanning device for the spool diameter, an adjustable timeclock or the like, there appears the signal S for the spool change, which occurs between spool journeys and by which the rotary movement of spool revolver 12 is brought about. At the end of signal S the gripper drive is triggered by the signal G which, through a sequence control, brings about the above-described gripper movements, is interrupted upon dropout of signal PI and is set in operation again only after reappearance of signal PII. In order to bridge over the brief overlap in zone 53 between the already returned signal PI and of the not-yet extinguished signal PII in zone 53, relay RI in the relay cirucit, FIG. 5*a*, has a time delay. The functioning of the relay circuit shown may be briefly described as follows:

The gripper movement out of position II*a* into position II*b* is triggered in the course of a sequence control by contact L, FIG. 5*a*, (left movement of the gripper rod 20). If the two photoelectric cells I and II show an output signal, relays RI, RII and RIII operate, so that valve 54 is operated in such a way that the gripper rod 20 is actuated in the left direction and the gripper transports the bobbin 52 over the conveyor 23. If now a full bobbin 51 approaches on the conveyor 23 and hence the signal of the photoelectric cell 25I drops out, the gripper drive is interrrupted as shown in the chart, FIG. 5*c*, and valve 54 is spring-reset in such a way that bobbin 52 is again driven out of the conveying zone. Now there appears briefly the signal of photoelectric cell 25I, but not long enough to bridge over the time delay 53 which makes relay $R_I$ slow to operate. At this moment, therefore, the gripper drive is not set in operation again. Only when the signals of photocells I and II are again simultaneously present, i.e. after spool 51 in its movement to the right has cleared photocell II, is the gripper drive again set in operation by means of relays RII and RIII. It should be noted that in FIG. 5*a* there are represented only those parts of the gripper control that serve to prevent collisions. An example for the sequence control proper of the gripper movement will be given hereinbelow in connection with the embodiment of FIGS. 3, 4.

Figure 3:
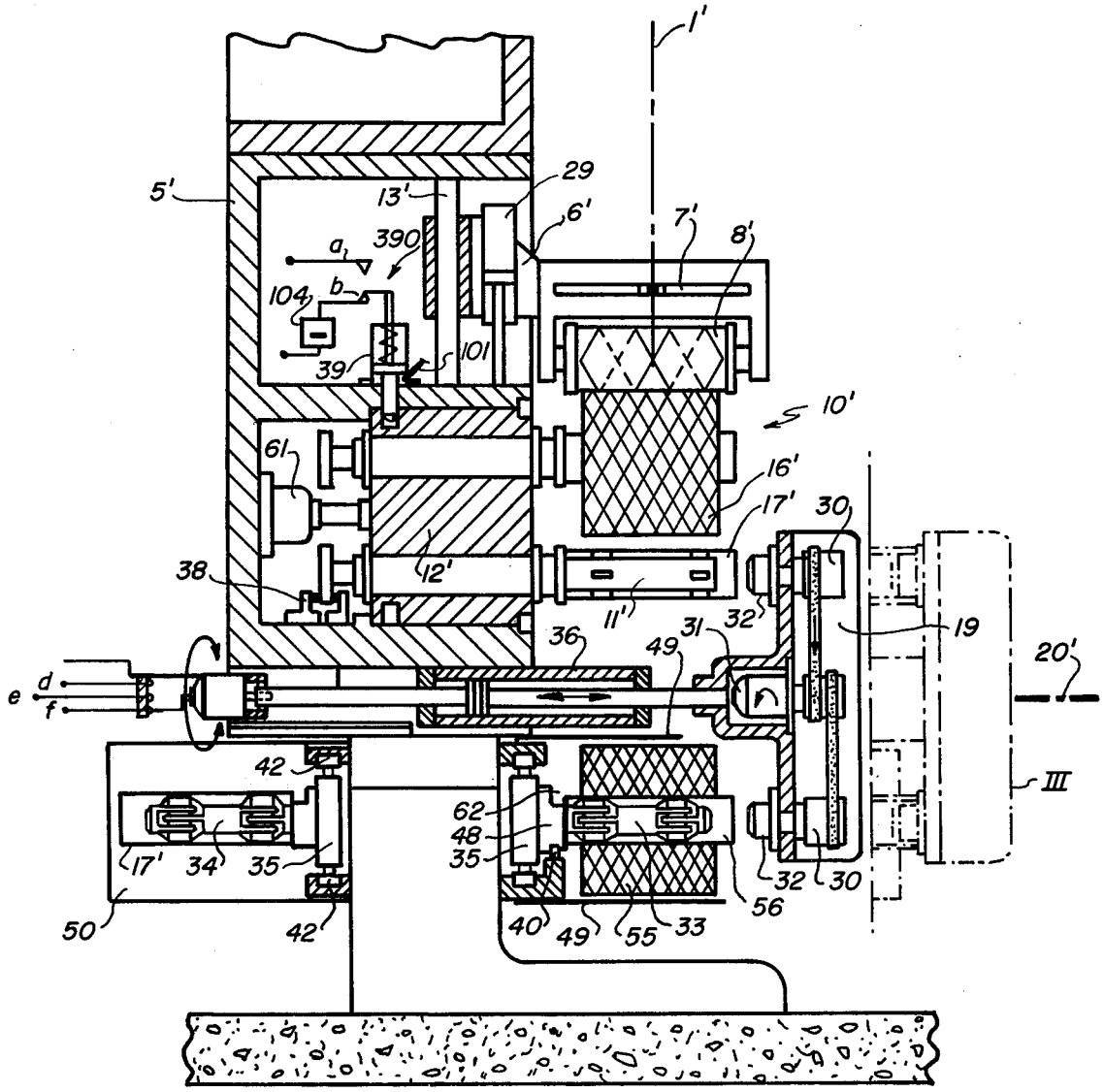
FIG. 3 is a front view of a textile machine with a second embodiment of a spool-changing apparatus according to the invention, having associated therewith a conveyor which in this instance serves for the transportation both of full spools and of empty tubes.

FIGS. 3 and 4, which will now be described, also show further details of the winding apparatus which are likewise applicable to the embodiment according to FIGS. 1 and 2. This applies especially to guide 13' and cylinder-piston unit 29, which serve for the up and down movement of the slide 6', the cylinder-piston unit 36 for the back and forth movement of the gripper, motor 37 for the swinging movement of the gripper, and brake 38 for the braking of the chuck in rest position.

According to FIGS. 3 and 4 there are used chucks of the type disclosed in U.S. Pat. No. 3,815,836 to Munnekehoff et al, issued June 11, 1974. Such chucks are released by slightly rotating the tube carried by them, with respect to the chuck. For this, brake 38 must first be actuated.

The automatic spool-changing apparatus according to FIG. 3 and FIG. 4 is distinguished especially by a two-armed gripper 19'. The gripper has two like gripping heads 32. The gripping heads consist essentially of tensioning jaws which are movable radially outwardly and which may be pressed outwardly or may be retracted by a pneumatically, magnetically or otherwise operated tensioning device 30. In this connection reference is made to German petty patent (Gebrauchsmuster No. 6,945,314. The gripping heads 32 and tensioning devices 30 are slightly rotatable by means of motor 31. This rotation brings about the release of chuck 11—as already described. In the embodiment shown in FIGS. 3 and 4, the conveyor consists of a circulating chain 35, which is enclosed by cover plates 49, 50 and lies exposed only under individual winding devices for the gripper.

Figure 6:
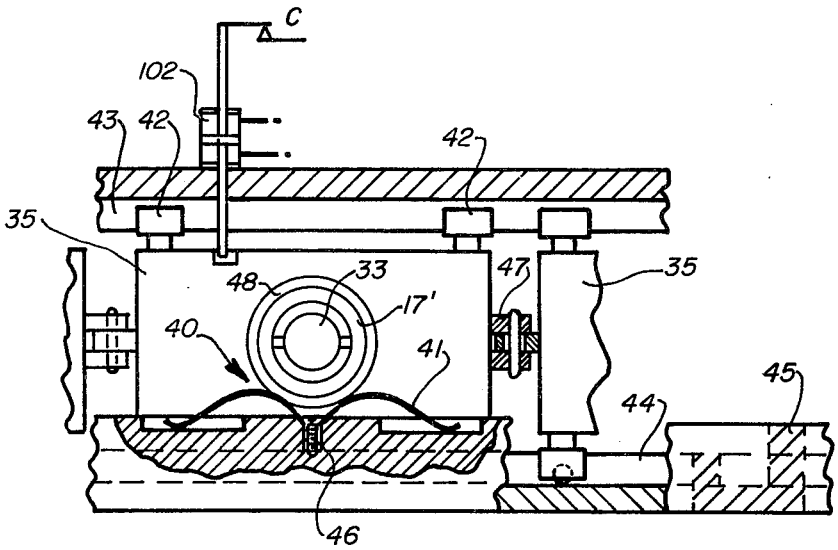
FIG. 6 is a detailed showing of the positioning arrangement of the conveyor according to the embodiment of FIGS. 3, 4.

As shown in FIG. 6, this chain is composed of individual plates on each of which there is fastened a projecting slip-on mandrel 33. The plates are connected to each other by flexible members 47. The drive (not shown in FIG. 6) of conveyor chain 35 is located on the front side of the machine. The conveyor chain is guided in an upper guide track 43 and a lower guide track 44. Each winding apparatus has associated therewith a positioning device for the slip-on mandrel. In the case illustrated, the positioning device consists of a leaf spring 41, which has two saddle portions. Between the two saddle portions the leaf spring is fastened with a screw 46. When a tensioning mandrel approaches a winding device, the collar 48 on which the slip-on mandrel is seated, slides over the first saddle portion of the leaf spring and is accurately positioned between the two saddle portions, so that the two gripper arms can reach the chuck 11' in rest position, and also the slip-on mandrel. Since the individual chain members are yieldingly joined with one another, each slip-on mandrel can reach exactly the location provided for it. In FIGS. 3 and 4 there is shown the position of the gripper after completion of a spool-changing operation. On chuck 11' which is in rest position there has been slipped an empty tube 17'. Slip-on mandrel 33 is shown carrying the finished spool that has just been drawn off. In this position of the gripper the conveyor which is at a standstill during the spool change, can be set in operation. In general, the changing operation is carried out by the gripping heads 32 of the gripper being simultaneously driven in axial direction into the tube of the finished spool (chuck 11') and the empty tube (slip-on mandrel 33), the heads being tensioned, then being driven out into position III, FIG. 3, and turned through 180°, and thereupon being driven back again. During these operations the conveyor stands still. Before the conveyor is again set in operation or when spool revolver 12' is rotated, gripper 19' must be in the same rest position shown.

The spool change of the individual winding devices can take place cyclically or at random. It is to be observed that the gripper has to be out of operation as long as the conveyor is in operation, and that the finished spool subsequent to the spool change, i.e., after the swinging movement of spool revolver 12', must be drawn off the chuck in rest position as quickly as possible; otherwise there would be the danger that the spool in operation might grow against the finished spool, and that breakage of the winding apparatus would result. In order to take this into account, there has been developed an advantageous method for the operation of the spool-changing apparatus, FIGS. 3, 4, which will now be described with reference to FIG. 7.

Figure 7:
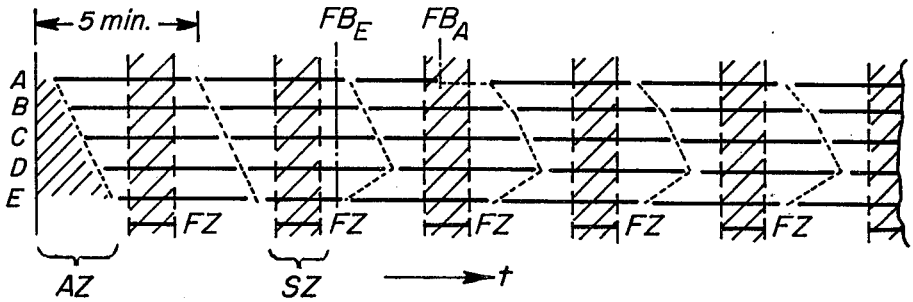
FIG. 7 is an operating chart illustrating the relative operating times of the individual positions of the textile machine according to the embodiment of FIGS. 3, 4.

FIG. 7 shows in an operating chart or bar diagram the operating periods of, for example, five winding devices with spool-changing devices A – E. As will be noted from this figure and, as will now be described in more detail, the operation of the individual winding devices takes place in a cyclic, multi-phase displaced manner. The time period for a spool journey (travel, "ride") which is assumed to have been selected to be 5 minutes. In this time, optimal filling of the spools can be attained for the given conveying speed and denier of the threads. The starting operation and the initial application of the threads take 30 seconds per winding device, so that the application time (AZ) for all five winding devices is 2.5 minutes. The phase displacement of the spool journeys of the individual winding devices, which is caused by the application times for the individual winding devices, is preserved for the entire operating time of the textile machine with its winding devices, provided that thread breakages or other operating troubles do not occur in a winding apparatus. The case of operating trouble will be treated further below. First, let it be pointed out that the conveyor—as shown by bar diagrams F—is taken into operation intermittently. The distance between the individual operating times corresponds to the adopted duration of a spool journey of 5 minutes. This means that in normal operations—i.e., without thread breakage—there could never occur any overlapping of the spool change with the conveying times (FZ) of the conveyor.

The functioning of the spool changing apparatus in the case of operational trouble will now be described on the basis of possible thread breaks.

The bar diagram of the winding apparatus E shows a thread break at the point FBE. This thread break lies outside the conveying time (FZ). For this reason the spool change can now take place without the need of further measures in the usual manner, namely, by rotating the spool revolver 12 until the empty tube is engaged by its peripheral drive, and the broken thread, sucked off temporarily by a suction device, is applied to the empty tube. Thereupon the spool-changing apparatus takes off the unfinished spool and replaces it by an empty tube sitting on the conveyor. The thread break at point FBE gives rise to a phase displacement in the operation of the winding apparatus E, which remains preserved in the future.

Now let it be assumed that a thread break takes place in the winding apparatus A at point FBA, namely, during the conveying time (FZ) of the conveyor. Through the operation of the conveyor both the rotary drive 61, FIG. 3, for the spool revolver and also the pneumatic drive 36 and the rotary drive 37 for the gripper on winding devices A – E are blocked. This blocking condition can only be removed when the conveyor has been reequipped with empty tubes and the individual slip-on mandrels with empty tubes have traveled back each to a winding apparatus. The thread breakage is now remedied and the spool change occurs as described above. The spool journeys of winding device A now have, with respect to the spool journeys of the other winding devices, a new phase displacement which remains preserved in the future. Let it be remarked that blocking takes place not just during the conveying time (FZ) of the conveyor but also during a certain safety interval (SZ) which is greater than the conveying time (FZ). During this safety interval already initiated spool-changing operations can be completed, to be sure, but no new spool-changing operations can be started.

Figure 8:
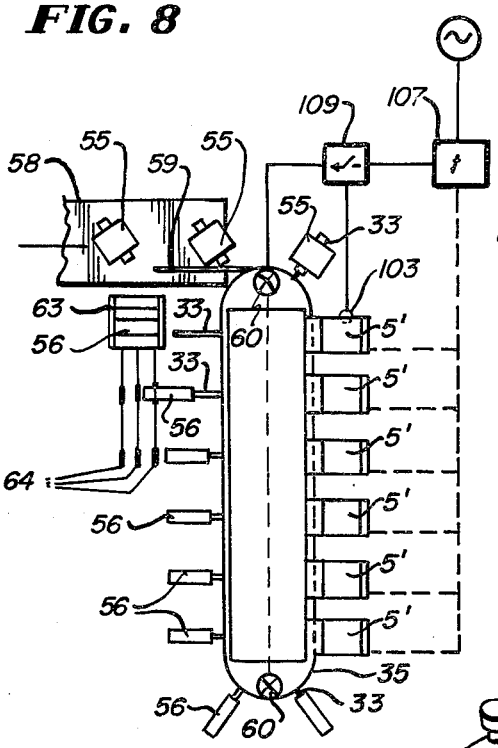
FIGS. 8 and 8*a*, the one in overall schematic representation and the other in a detailed fragmentary showing, illustrate arrangements used in the textile machine of FIGS. 3, 4 for removing the finished spools and for charging the conveyor with empty tubes at the machine head.
Figure 8A:
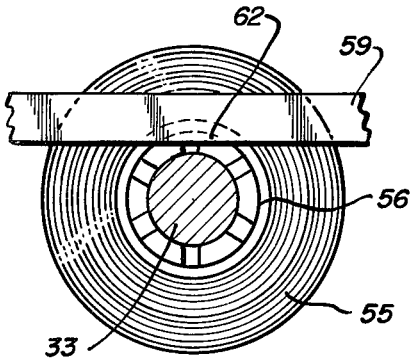
Figure 9:
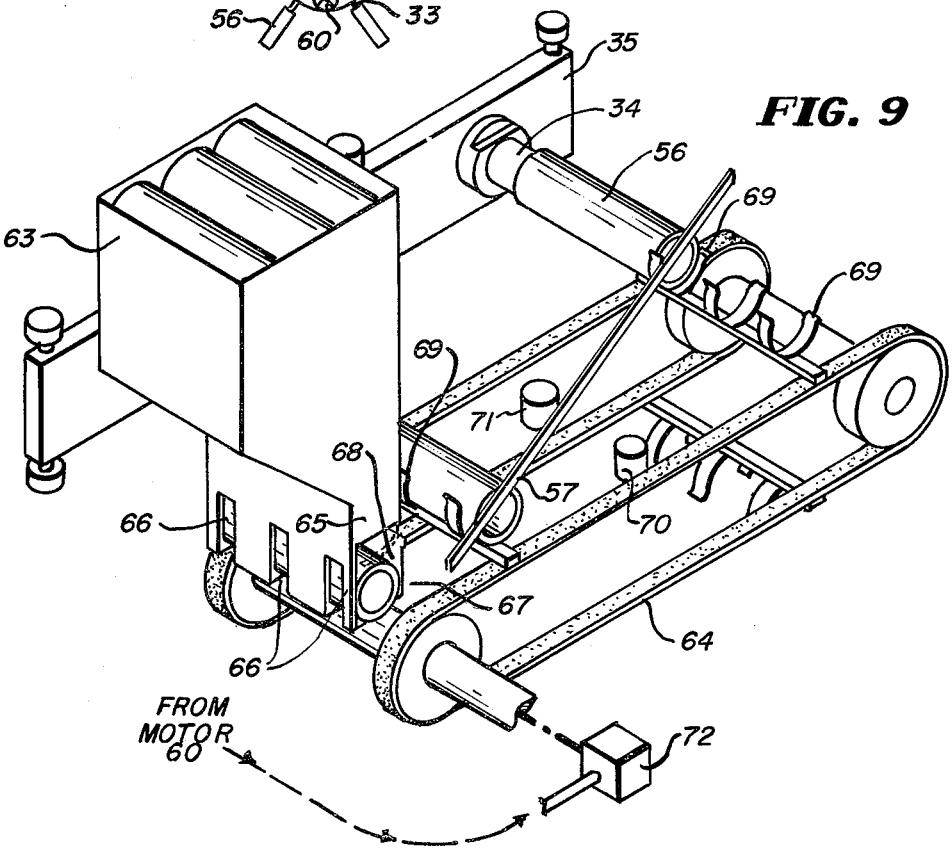
FIG. 9 shows apparatus for charging the conveyor of the embodiment of FIGS. 3, 4 with empty tubes.

In FIGS. 8 and 9, possible arrangements for the removal of the finished spools 5 from the slip-on mandrels 33 of the conveyor 35 according to FIGS. 3 and 4, and for the slipping of empty tubes 56 onto these slip-on mandrels, have been schematically illustrated.

As described above with reference to FIG. 7 endless circulating chain 35, FIG. 3, is intermittently driven at certain times. To this end there is provided in the circuit of motor 60 a clock 107 for the generation of a starting pulse, and a photocell 103 with a switch 109 for stopping motors 60 when a slip-on mandrel with an empty tube thereon appears within the detecting range of photocell 103. Thus, at the end of each predetermined interval, the chain is advanced by an amount such that a slip-on mandrel with an empty tube thereon is located under each winding device 5'.

As shown in FIG. 9, for the supplying of slip-on mandrels 34, 34 with empty tubes 56, the empty tube magazine 63 and the empty tube conveyor 64 are provided. Empty tube magazine 63 has in its lower part a chute 65 in which the empty tubes are "singled." The chute contains at its end three slits 66 as well as an outlet 67 which is closed by a resilient tongue 68. The empty tube conveyor 64 consists of two circulating chains. Its drive is synchronized with the drive 60 of the conveyor 35, namely by means of a mechanical gear transmission 72 schematically shown in FIG. 9. By virtue of this gear transmission conveyor 64 operates whenever motor 60 is running. The individual chains carry clamping brackets 69, which resiliently engage and clamp the empty tubes on their periphery. The clamping brackets are designed in such a way that their opening points in the direction of travel of the conveyor. For the clamping of a tube, the clamping brackets move into the slits 66 of the chute 65 and thus grip the lowermost tube. Under the spring action of the tongue 68 the tube is pressed into the clamping brackets and thereupon led out from opening 67. Thereafter, the tubes can be thrust by guide arm 57 in axial direction onto the slip-on mandrels 34 which move parallel to and synchronously with the empty-tube conveyor 64 and the tubes clamped thereon. Sensing elements 70 and 71 which, for example, may be pneumatic sensing elements, monitor whether each slip-on mandrel 34 is fitted with an empty tube. In case of proper fitting, sensing element 71 gives a signal, and sensing element 70 no signal, when a tube passes there. Deviations from this signalling pattern lead to a warning signal for the operating personnel.

Figure 10:
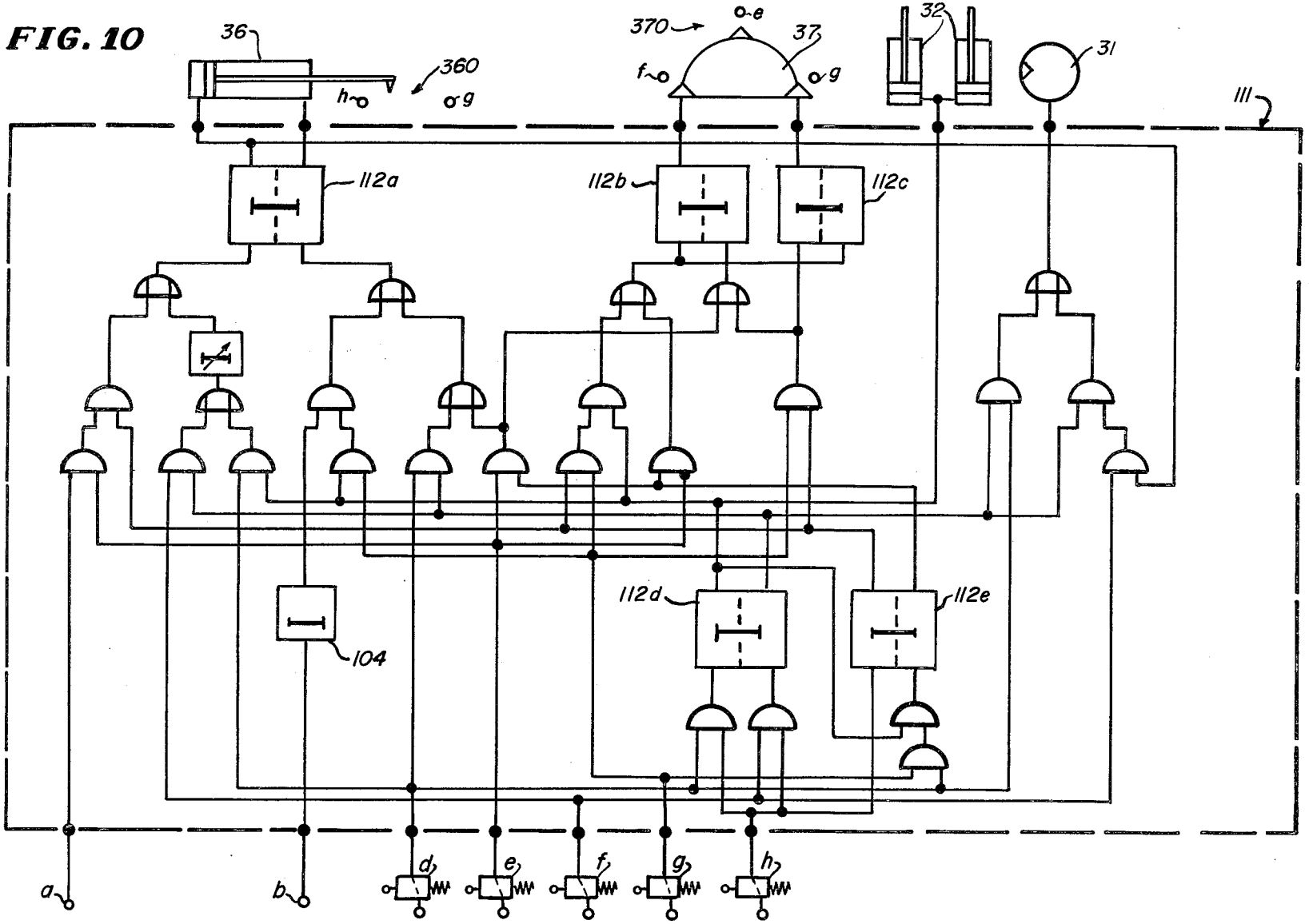
FIG. 10 is a diagram schematically illustrating the controls for the spool-changing operation of the textile machine FIGS. 3, 4.
Figure 11A:
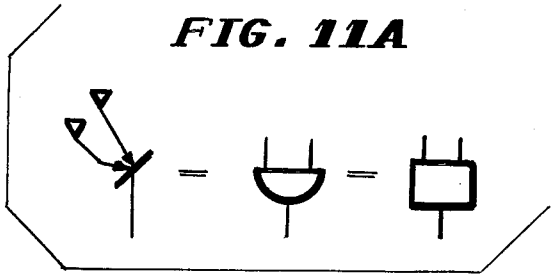
FIG. 11*a* gives an explanation of certain graphic symbols employed in FIG. 11.
Figure 11:
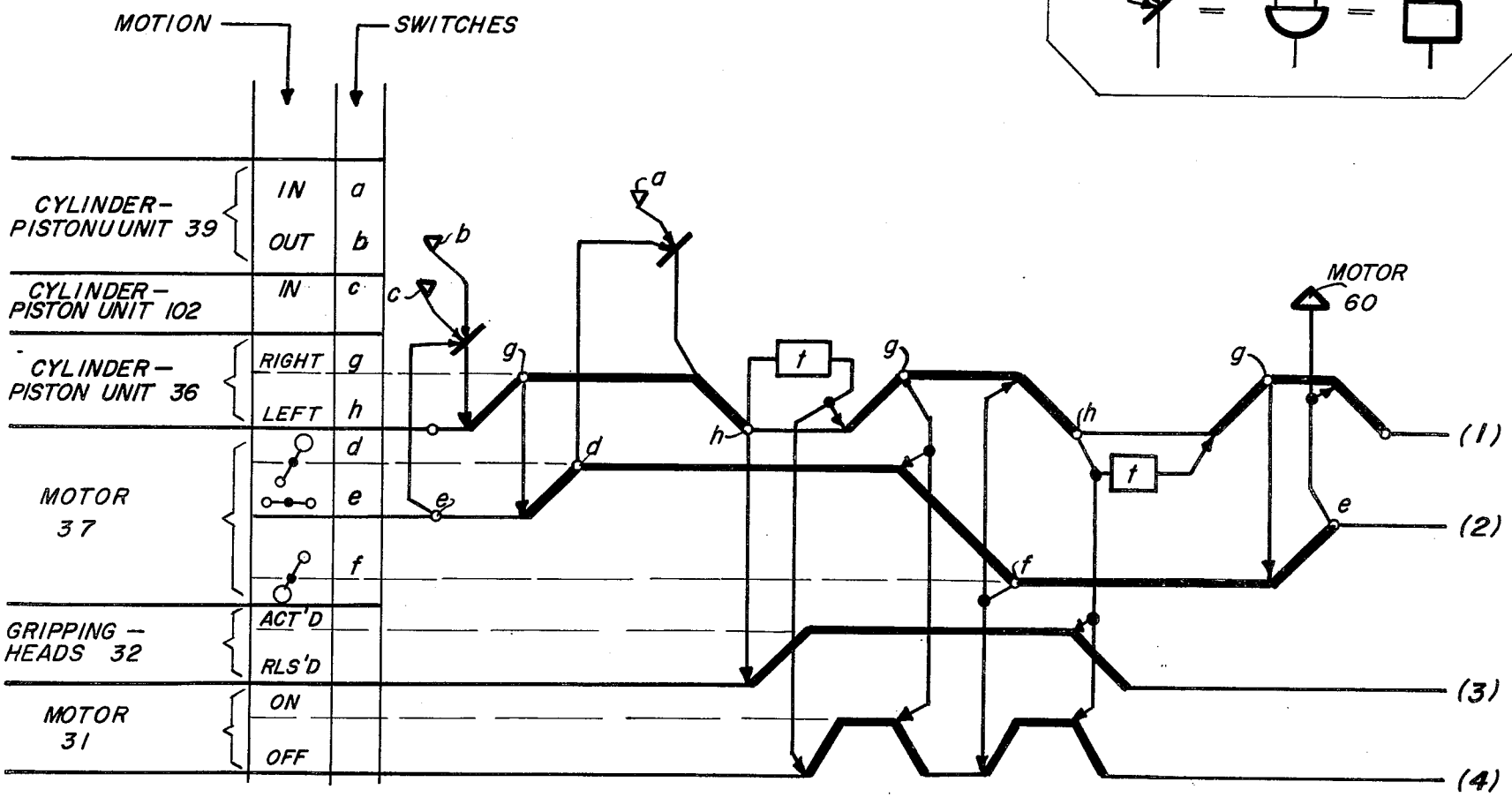
FIG. 11 is a corresponding chart illustrating the sequence of the functions involved in the last-mentioned operation, and also indicating the switches initiating these functions.

Turning now to the sequencing of the spool-changing operation proper, the chart shown in FIG. 11 illustrates the sequence of the various functions performed by the winding machine equipped with the spool-changing apparatus according to the embodiment of FIGS. 3 and 4. FIG. 10 is a corresponding functional diagram schematically showing the control logic–generally designated 111 in FIG. 10–together with the controlling and controlled devices employed in this embodiment. In this connection it should be noted that the functional diagram, FIG. 10, is applicable to electric, pneumatic or any other implementation of the aforementioned devices and, for that matter, of the control logic as well. In view of the explanation given below with reference to FIG. 11, it will be sufficient to mention with respect to this control logic that 112*a* to 112*e* are flip-flop devices; that 104 is a delay device; and that the remaining logic elements of control logic 111 are AND gates and OR gates.

As indicated at the bottom and, in part, also at the top of FIG. 10, the following switches are used:

1. *a* and *b*, indicated in FIG. 10 only by their connecting terminals, are switches at cylinder-piston unit 39, FIG. 3. As will be noted from an inspection of FIG. 3, switch *a* is normally operated when the piston of unit 39 is in one of its locking positions while switch *b* is closed when the piston upon admission of compressed air through inlet 101 has been driven upwardly in FIG. 3 into non-locking position. Switch means *a*, *b* as a whole have been designated as 390 in FIG. 3 and delay device 104 has also been indicated in this figure.

2. *c* is a switch controlled by a cylinder piston unit 102, FIG. 6, which, in the condition shown there, locks chain 35 in position.

3. *d*, *e* and *f* are limit switches controlled by motor 37, FIGS. 3 and 10, for the swinging movement of gripper 19'. With reference to FIG. 3 this switching means, as a whole designated as 370, comprises a wiper member mounted on the shaft of motor 37 and engaging three relatively stationary contacts mounted on a disk of insulating material. The disk and the contacts thereon, as well as the wiper arm engaging them, partake in the translational movement of the piston of cylinder-piston unit 36 within the corresponding bore of the winding machine.

4. *g*, *h* are limit switches controlled by cylinder-piston unit 36, FIGS. 3 and 10. This switching means itself, generically designated as 360 in FIG. 10, has not been particularly shown in FIG. 3.

In addition to the foregoing, FIG. 10 in its top portion also schematically indicates the units for actuating gripper heads 32, FIG. 3, as well as motor 31 for releasing chucks 11', in the manner described above.

The operation of the sequencing arrangement is as follows:

The spool change on the winding devices is initiated by a clock or by a spool-diameter sensing device not shown in the drawings. In order to effect a spool change, spool revolver 12' must be rotated by motor 61. To bring this about, compressed air is first admitted to cylinder-piston unit 39 by way of inlet 101 so that the piston rod of cylinder piston unit 39 releases the spool revolver for rotation. In this manner switch *b* is operated. Simultaneously a signal is generated by switch *c*, FIG. 6, which indicates that circulating chain 35 is in position and must not be moved. The piston of cylinder piston 102 is actuated under the control of the optical senser 103, FIG. 8, which transmits a signal when even the last slip-on mandrel 33 carries an empty tube rather than a full spool. As schematically indicated in line (1) of FIG. 11, signals *b* and *c* in conjunction cause the piston of cylinder-piston unit 36 to move outwardly, that is, to the right in FIG. 3. At this time the cross arm of gripper 19' is in horizontal position so that limit switch *e* is also operated.

After the gripper has reached its outermost right position limit switch *g* is operated as shown in FIG. 10. Switch *g*, in turn, now operates motor 37, FIGS. 3, 10 and 11, which rotates the gripper by approximately 90°, namely to the right as viewed in the diagrammatic showing at the top of FIG. 10. The rotation of motor 37 causes limit switch *d* to be actuated. At this time the rotation of spool revolver 12' has also been completed so that the piston of cylinder piston unit 39 again locks spool revolver 12', thereby operating switch *a*. The signal produced by switch *a* is forwarded through delay device 104 and, in conjunction with the signal of limit switch *d* again actuates cylinder-piston unit 36 so that the gripper is now retracted, that is, moved toward the left in FIG. 3, as indicated schematically in line (1) of FIG. 11.

In the process, gripping heads 32 enter empty tube 17' and tube 56 of full spool 55, FIG. 3. As shown in FIG. 10, the cylinder-piston unit in moving to the left, operates limit switch *h*. Limit switch *h* again actuates gripping heads 32 as shown in line (4) of FIG. 11, and, with a time delay, again actuates cylinder-piston unit 36 as well as driving motor 31; the latter slightly rotates the gripping heads 32 and thereby releases chuck 11', as shown in lines 1 and 4 of FIG. 11. The gripper now moves to the right again, see line 1 of FIG. 11, and in doing so draws the full spool and the empty tube off chuck 11' and slip-on mandrel 33, respectively. In moving in the right direction the gripper again actuates switch *g;* this switch in closing shuts off motor 31 and also operates motor 37 in the opposite direction (left in FIG. 10). This causes the gripper to be rotated by 180° until switch *f* is operated. Switch *f* again actuates motor 31, see line 4 of FIG. 11, and cylinder-piston unit 36, see line 1, so that the gripper moves to the left and thus causes an empty tube to be slid on chuck 11' and the full spool on slip-on mandrel 33. This condition is illustrated in FIGS. 3 and 4. Limit switch *h* which is actuated in this manner, now disables gripping heads 32 so that the tubes and the full spool are released.

In addition, motor 31 is shut down, as shown in line 4 and, with a time delay, cylinder piston unit 36 is again actuated as shown in line 1. The gripper now moves to the right again and thus operates limit switch *g*. Limit switch *g* turns on the rotational drive 37 so that the gripper is rotated by approximately 90° and thereby closes limit switch *e*. As schematically indicated in FIG. 11, limit switch *e* gives a signal to motor 6, FIG. 8, so that motor 6 and chain 35 can again be operated when the clock 107 transmits the required triggering signal. At the same time limit switch *e* transmits a signal to the cylinder switching unit 36, line (1) of FIG. 11, so that the gripper is moved to the left into its normal position.

It should be understood that the embodiments described above are for illustration only and should not be construed in a limiting sense.

We claim:

1. In a textile machine including:

a plurality of winding apparatus, disposed in a horizontal array along the front of the machine, for winding a multifilament synthetic yarn which is continuously fed to said apparatus at a constant high velocity, each said apparatus having, in a corresponding spool-changing position, a spool holder journaled in said machine with the axis of said holder projecting from the front of said machine;

a spool conveyor mounted for horizontal movement along the machine front; and an automatic spool changing apparatus having a gripping means movable between the conveyor and the spool-changing position of the spool holder;

the improvement:

that said conveyor is disposed in substantially the same vertical plane with, and at a level below, said spool holders, and that said gripping means is mounted for movement along a spool-doffing path which extends forwardly of the machine front and comprises three legs, the first leg of said path extending from said spool-changing position of the spool holder, along a line parallel to the axis of said holder, forwardly to an upper out-of-the-way position, the second leg extending, in a plane perpendicular to the axis of said holder, from said upper out-of-the-way position to a lower out-of-the-way position, and the third leg extending from said lower out-of-the-way position, along a line parallel to the axis of said holder, rearwardly to a conveyor discharge zone.

2. In a textile machine including:

a plurality of winding apparatus, disposed in a horizontal array along the front of the machine, for winding a multifilament synthetic yarn which is continuously fed to said apparatus at a constant high velocity, each said winding apparatus comprises a revolver supported for rotational movement about an axis perpendicular to the front of the machine, and wherein two spool holders, projecting perpendicularly from the machine front are journaled in said revolver, about axes parallel to the revolver axis, in such relative locations on said revolver that while one of said holders is in a working position, the other is in a spool-changing position and vice versa;

a spool conveyor mounted for horizontal movement along the machine front; and an automatic spool-changing apparatus having a gripping means movable between the conveyor and said spool-changing position of the corresponding spool holder;

the improvement:

that said conveyor is disposed in substantially the same vertical plane with, and at a level below, said spool holders, and that said gripping means is mounted for movement along a spool-doffing path which extends forwardly of the machine front and comprises three legs, the first leg of said path extending from said spool-changing position of the corresponding spool holder, along a line parallel to the axis of said holder, forwardly to an upper out-of-the-way position, the second leg extending, in a plane perpendicular to the axis of said holder, from said upper out-of-the-way position to a lower out-of-the-way position, and the third leg extending from said lower out-of-the-way position, along a line parallel to the axis of said holder, rearwardly to a conveyor discharge zone.

3. In a textile machine the improvement as claimed in claim 2 wherein there is provided, adjacent said revolver, a thread guide means actuated to draw the almost finished spool on said one spool holder out into a thread loop such that the thread comes into a zone of action of a thread-catching means effecting a lossless transfer of the thread from the last-mentioned spool to an empty tube carried by said other spool holder.

4. In a textile machine the improvement as claimed in claim 2 wherein said upper and lower out-of-the-way positions are spaced from each other by an amount at least equal to the sum of the radii of the finished spool and the empty tube.

5. In a textile machine the improvement as claimed in claim 1 wherein said gripper means comprises a shaft carrying at least one arm with a gripper head thereon, said shaft being mounted for shifting movement along, and swinging movement about, an axis extending perpendicularly to the front of the machine.

6. In a textile machine the improvement as claimed in claim 5 wherein there are provided control apparatus, said control apparatus comprising sensing means adjacent said conveyor and comprising control means actuated under the control of said sensing means, if said conveyor is loaded with a finished spool approaching a winding apparatus in spool-changing condition, to initiate a blocking action, thereby to prevent collision of a finished spool being doffed at said position, with said approaching spool on said conveyor.

7. In a textile machine the improvement as claimed in claim 6 wherein said control means is actuated under the control of said sensing means, if said conveyor is loaded with a finished spool approaching a winding apparatus in spool-changing condition, to disable the gripping means at said winding apparatus.

8. In a textile machine the improvement as claimed in claim 5 wherein there are provided empty-tube storage means having an empty-tube supply location also lying in substantially the same vertical plane with said spool holders; and wherein said gripping means is also movable, over a three-legged spool donning path extending forwardly of the machine front, between said storage means and the spool-changing position of said spool holder, the first leg of said spool donning path extending from said empty-tube supply position, along a line parallel to the axis of said spool holder, forwardly to an out-of-the-way position, the second leg of said spool-donning path extending, in a plane perpendicular to the axis of said spool holder, from the last-mentioned out-of-the-way position to another out-of-the-way position, and the third leg of said spool-donning path extending from said other out-of-the-way position, along a line parallel to the axis of the spool holder, rearwardly to said spool-changing position of the spool holder.

9. In a textile machine the improvement as claimed in claim 8 wherein said empty-tube storage means comprises an empty-spool magazine disposed above the level of said spool-changing position of the spool holder, in the space between adjacent winding apparatus.

10. In a textile machine the improvement as claimed in claim 5 wherein said conveyor is equipped with two spool-holding devices per machine pitch which alternately provide an empty-tube supply location and a finished-spool deposition location, the axes of said two devices being parallel to those of said spool holders and lying on the swinging path of said gripper head.

11. In a textile machine the improvement as claimed in claim 5 wherein said shaft carries two angularly displaced arms each carrying, at the same radial distance from the shaft axis, its own gripper head, thereby permitting a spool-doffing operation and a spool-donning operation to be simultaneously executed by the same swinging movement of said shaft.

12. In a textile machine the improvement as claimed in claim 5 wherein there are provided a plurality of gripper means each individually associated with, and mounted for said two movements in, a corresponding one of said winding apparatus.

13. In a textile machine the improvement as claimed in claim 11 wherein said conveyor comprises a plurality of chain members each having one of said spool holding devices thereon, said chain members being yieldingly linked to each other lengthwise of the chain, and wherein each said winding apparatus is provided with a centering device, said centering device cooperating with the spool-holding device of the chain member when located at said winding apparatus, to accurately position said chain member lengthwise of said chain in the swinging path of said gripper head.

14. In a textile machine the improvement as claimed in claim 11 wherein there are provided:

first driving means for moving the shaft carrying said gripping means longitudinally in opposite directions;

second driving means for rotating said shaft;

first control devices for actuating and releasing said gripper heads;

second control devices for actuating and releasing said tube chucks;

first and second switch means controlled by said first and second driving means respectively; and logic means controlled, at least in part, by said first and second switch means to sequence the operation of said first and second driving means and said first and second control devices so as to cause said spool-changing apparatus to execute said simultaneous spool-doffing and spool-donning operation.

15. In a textile machine the improvement as claimed in claim 14 wherein there are provided:

sensing apparatus detecting the presence at said winding apparatus of an empty spool on said conveyor;

locking means actuated under the control of said sensing apparatus to lock said conveyor in position;

third switch means actuated by said locking means when in locking condition; and control connections preventing the initiation of said simultaneous spool-doffing and spool-donning operation unless said third switch means is in actuated condition.

16. In a textile machine the improvement as claimed in claim 15 wherein the individual winding apparatus of said machine is actuated in cyclic, mutually phase-displaced relationship and wherein there are provided means for intermittently driving said conveyor at time intervals spaced from each other by the duration of a spool journey, such that in the absence of thread breakage an overlap between the spool-changing operation at any of said winding apparatus and the driving time of said conveyor is avoided.

* * * * *